US007669788B2

(12) United States Patent
Park et al.

(10) Patent No.: US 7,669,788 B2
(45) Date of Patent: Mar. 2, 2010

(54) FLUID INJECTOR FOR TREATING SURFACE OF FLAT DISPLAY PANEL

(75) Inventors: Yong-Seok Park, Seoul (KR); Kyoung-Heon Heo, Hwasung (KR); Seung-Won Lee, Goyang (KR)

(73) Assignee: DMS Co., Ltd., Suwon (KR)

( * ) Notice: Subject to any disclaimer, the term of this patent is extended or adjusted under 35 U.S.C. 154(b) by 1367 days.

(21) Appl. No.: 10/864,994

(22) Filed: Jun. 10, 2004

(65) Prior Publication Data

US 2005/0034747 A1 Feb. 17, 2005

(30) Foreign Application Priority Data

Jun. 27, 2003 (KR) ..... 10-2003-0042580

(51) Int. Cl.
*B05B 1/26* (2006.01)

(52) U.S. Cl. ..... 239/520; 239/521

(58) Field of Classification Search ..... 239/520, 239/521, 451, 548, 566, 568, 598, 600, 76; 60/39.31, 39.37, 737; 138/111, 114
See application file for complete search history.

(56) References Cited

U.S. PATENT DOCUMENTS 3,612,799 A * 10/1971 Carter et al. ..... 218/51
4,418,456 A * 12/1983 Riehl ..... 29/890.02
4,570,601 A * 2/1986 Ito et al. ..... 123/468
4,870,818 A * 10/1989 Suliga ..... 60/740
4,955,409 A * 9/1990 Tokuda et al. ..... 137/561 A
6,584,774 B1 * 7/2003 Stanek ..... 60/740

* cited by examiner

*Primary Examiner*—Davis Hwu
(74) *Attorney, Agent, or Firm*—Marshall, Gerstein & Borun LLP

(57) ABSTRACT

A fluid injector for treating a surface of a flat display panel includes a case provided with a cavity for receiving fluid; a pair of nozzle guiders coupled to the case and disposed facing each other; a gap-adjusting plate disposed between the nozzle guiders to adjust a gap between the nozzle guiders; and a coupling device for coupling the nozzle guiders to the gap-adjusting plate.

17 Claims, 3 Drawing Sheets

FLUID INJECTOR FOR TREATING SURFACE OF FLAT DISPLAY PANEL

BACKGROUND OF THE DISCLOSURE

1. Field of the Disclosure

The disclosure relates to a fluid injector, and more particularly to a fluid injector that can be used to treat a surface of a flat display panel, and that improves injection precision.

2. Description of Related Art

Generally, a fluid injector used for treating a surface of a flat display panel is formed having a length greater than a width of the panel, and is provided with a nozzle having an uneven surface. However, the uneven surface makes it difficult to uniformly treat an inner surface of the panel. Furthermore, when intervals between the nozzles are not uniform, the injection precision is deteriorated.

In addition, the conventional fluid injector has a drawback in that pressures of the injection nozzles are not uniform, so the surface of the panel cannot be precisely processed.

Furthermore, due to the length of the injection nozzle, the dispensing and flow rate of the fluid are not uniformly realized in the course of injecting the fluid.

SUMMARY OF THE DISCLOSURE

Accordingly, the disclosure is directed to a fluid injector that substantially obviates one or more problems due to limitations and disadvantages of the related art.

The disclosure provides a fluid injector for treating a surface of a flat display panel that can enhance injection precision by uniformly forming an interval between nozzles.

The disclosure further provides a fluid injector for treating a flat display panel that can improve injection precision by uniformly forming fluid pressure at the nozzles.

The disclosure further provides a fluid injector for treating a flat display panel that can improve injection precision by not being affected by the length of a nozzle, thereby providing uniform fluid dispensing.

In one embodiment according to the disclosure, a fluid injector for treating a surface of a flat display panel includes a case provided with a cavity for receiving fluid; a pair of nozzle guiders coupled to the case and disposed facing each other; a gap-adjusting plate disposed between the nozzle guiders to adjust a gap between the nozzle guiders; and a coupling connecting the nozzle guiders to the gap-adjusting plate.

According to another embodiment, the disclosure provides a fluid injector for treating a surface of a flat display panel including a case provided with a cavity for receiving fluid, and a nozzle guider coupled to the case, the nozzle guider defining a nozzle portion and a pressure-adjusting cavity where pressure of the fluid is adjusted before being injected through the nozzle portion.

According to still another embodiment, the disclosure provides a fluid injector for treating a surface of a flat display panel including a case provided with a cavity for receiving fluid, a nozzle guider coupled to the case to define a nozzle portion, and a tube disposed in the cavity of the case to receive fluid from a fluid-supplying apparatus, the tube being provided with a plurality of exhaust holes arranged at predetermined intervals.

Both the foregoing general description and the following detailed description are exemplary and explanatory, and are intended to provide further explanation of the invention as claimed.

BRIEF DESCRIPTION OF THE DRAWINGS

The accompanying drawings are incorporated in and constitute a part of this disclosure, and illustrate embodiments of the disclosed fluid injectors, and together with the description serve to explain the principles thereof. In the drawings.

DETAILED DESCRIPTION

Reference will now be made in detail to the preferred embodiments of the fluid injector, examples of which are illustrated in the accompanying drawings. Wherever possible, the same reference numbers will be used throughout the drawings to refer to the same or like parts.

Figure 1:
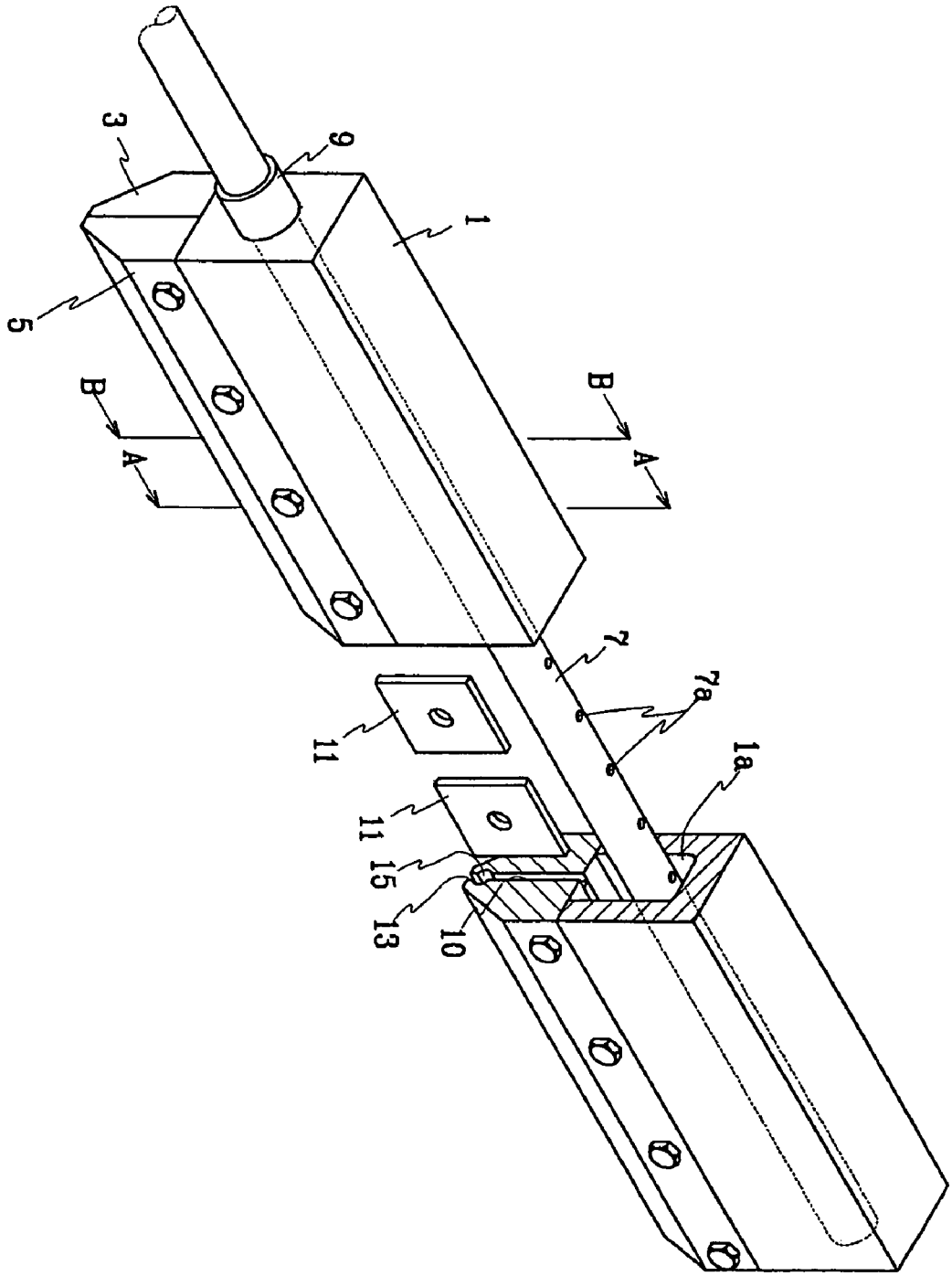
FIG. 1 is a perspective view of a fluid injector according to a preferred embodiment of the disclosure.
Figure 2:
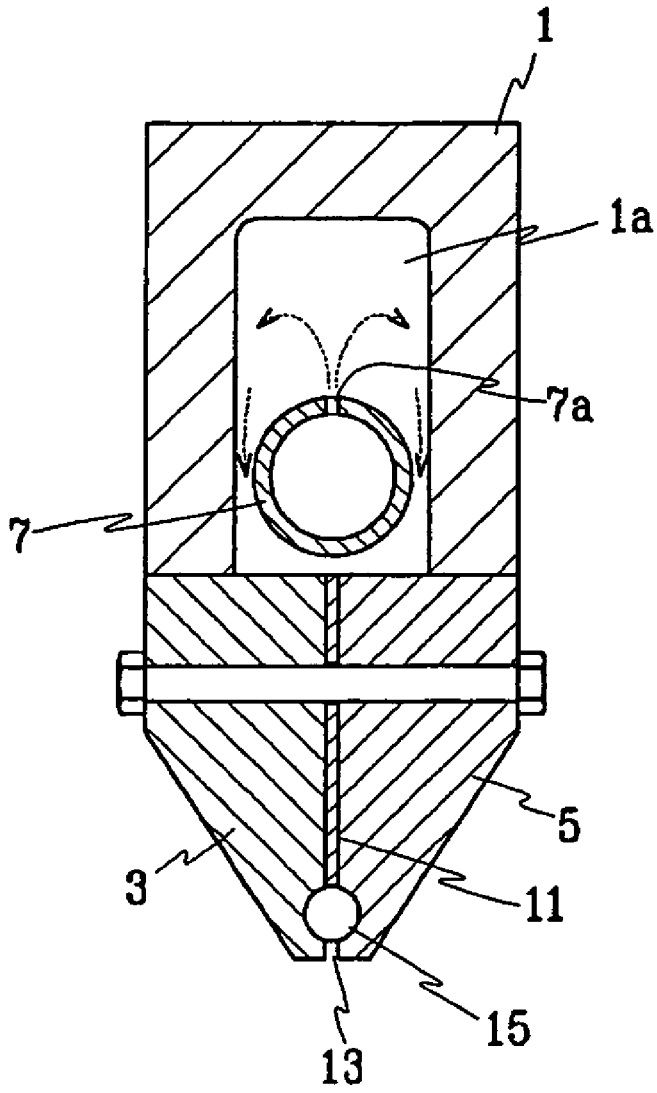
FIG. 2 is a sectional view taken along line A-A of FIG. 1.
Figure 3:
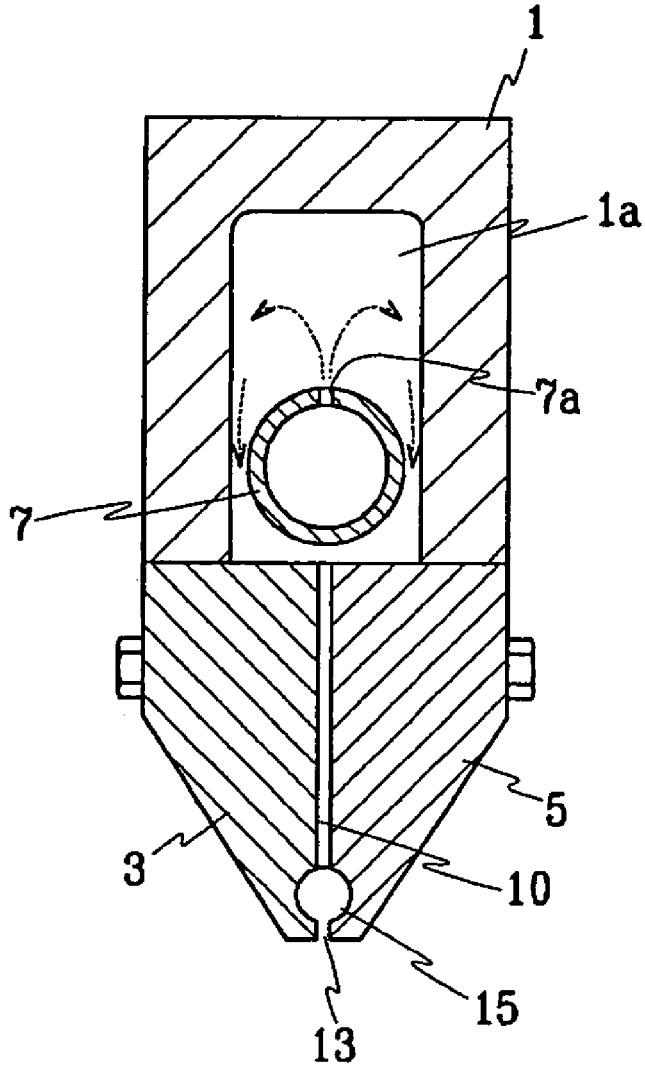
FIG. 3 is a sectional view taken along line B-B of FIG. 1.

FIGS. 1 and 2 show a fluid injector including a case 1, nozzle guiders 3 and 5 coupled to the case 1, and a tube 7 disposed in a cavity 1*a* defined by the case 1. The fluid can be liquid agents or fresh air, for example.

The case 1 and the cavity 1*a* are formed in a longitudinal direction. The tube 7 is disposed in the cavity 1*a* to receive the fluid from a separate fluid-supplying device (not shown). That is, the fluid is introduced into the case through a fitting 9 fitted on a side end of the case. The tube 7 may be omitted if required. That is, the fluid can be directly fed to the cavity 1*a* defined by the case 1. The tube 7 is provided with exhaust holes 7*a* formed upwardly at predetermined intervals, and the exhaust holes 7*a* allow the fluid introduced horizontally to be directed into the cavity 1*a* of the case 1 in a vertical direction.

The nozzle guiders 3 and 5 are paired, having opposing surfaces treated so that they are not uneven. A plurality of gap-adjusting plates 11 are disposed between the nozzle guiders 3 and 5. Passages 10 are defined by the gap-adjusting plates 11 and the nozzle guiders 3 and 5, communicating with the cavity 1*a* of the case 1 and allowing the fluid to be directed to a nozzle portion 13 formed by the nozzle guiders 3 and 5.

The nozzle guiders 3 and 5 and the gap-adjusting plate 11 are coupled to each other by a couple device, e.g., a fastener such as a bolt and nut, or a screw.

A pressure control cavity 15 is provided between the nozzle guiders 3 and 5 near the nozzle portion 13 to spray the fluid through the nozzle portion 13 at a uniform pressure. The fluid introduced into the tube 7 is uniformly adjusted in pressure while being directed to the cavity 1*a* through the exhaust holes 7*a*.

The fluid flow process is described in more detail below.

When the fluid is supplied from the fluid supply device (not shown) to a side of the case 1, the fluid is introduced into the tube 1 in a horizontal direction and is then exhausted to the cavity 1*a* of the case 1 through the exhaust hole 7*a* in a vertical direction, in the course of which the pressure of the fluid is uniformly adjusted while a flowing direction thereof is changed. As a result, the fluid is sprayed through the nozzle portion 13 along the passages 10 defined by the nozzle guiders 3 and 5 and the gap-adjusting plates 11. At this point, since the pressure control cavity 15 is provided near the nozzle portion 13, the fluid is temporarily collected in the cavity 15 to uniformly adjust the pressure. The adjusted fluid is uniformly sprayed through the nozzle portion 13.

As described above, since a gap of the nozzle portion 13 is adjusted by the gap-adjusting plates 11, the opposing surfaces of the nozzle guiders 3 and 5 can be easily treated, thereby reducing manufacturing costs. In addition, since the pressure of the fluid is uniformly adjusted while passing through the cavity 1*a* and the pressure-adjusting cavity 15, the fluid can be sprayed at a uniform pressure even when the nozzle portion 13 is lengthened. As a result, the injection precision of the fluid is improved to ideally perform the surface treatment of the flat display panel. Furthermore, since the fluid is uniformly injected, it is possible to reduce the amount of fluid used.

Since it is easy to manufacture the relatively lengthened nozzle, manufacturing costs can be minimized. In addition, since the nozzle portion has a uniform gap, the fluid injection precision can be improved.

Furthermore, since the exhaust holes are formed to be vertical to the fluid inlet direction, the pressure and speed of the fluid can be uniformly adjusted while it changes its flowing direction, so the fluid injection precision can be further improved.

In addition, pressure of the fluid can be adjusted by the pressure-adjusting cavity immediately before it is injected through the nozzle portion, so the fluid injection precision can be further improved.

It will be apparent to those skilled in the art that various modifications and variations can be made in the disclosed fluid injector. Thus, the disclosure covers the modifications and variations of this invention provided they fall within the scope of the appended claims and their equivalents.

What is claimed is:

1. A fluid injector for treating a surface of a flat display panel, comprising:

a case provided with a cavity for receiving fluid, the case and cavity being formed along a longitudinal direction;

a pair of nozzle guiders coupled to the case and disposed facing each other;

a plurality of gap-adjusting plates disposed between the nozzle guiders to adjust a gap between the nozzle guiders;

a nozzle portion formed by the nozzle guiders;

a plurality of passages defined by the gap adjusting plates and the nozzle guiders, the plurality of passages communicating with the cavity of the case and allowing the fluid to be directed to the nozzle portion;

a pressure control cavity disposed between the nozzle guiders near the nozzle portion to spray the fluid through the nozzle portion at a uniform pressure; and a couple device fixedly coupling each of the nozzle guiders to the gap-adjusting plates.

2. The fluid injector of claim 1, further comprising a tube disposed in the cavity of the case to receive fluid from a fluid-supplying apparatus, the tube being provided with a plurality of exhaust holes arranged at predetermined intervals.

3. The fluid injector of claim 2, wherein the fluid exhaust holes are formed such that they can exhaust fluid in a direction opposite to a direction where the fluid is injected.

4. The fluid injector of claim 1, wherein the nozzle guiders define the nozzle portion and the pressure-adjusting cavity where pressure of the fluid is adjusted before being injected through the nozzle portion.

5. The fluid injector of claim 1, wherein the couple device is selected from the group consisting of a bolt/nut assembly and a screw.

6. The fluid injector of claim 1, wherein the pair of nozzle guiders comprise opposing surfaces treated such that they are not uneven.

7. The fluid injector of claim 1, wherein the pair of nozzle guiders comprise elongated linear plates having opposing longitudinal surfaces defining the plurality of passages and the nozzle portion.

8. A fluid injector for treating a surface of a flat display panel, comprising:

a case provided with a cavity for receiving fluid, the case and cavity being formed along a longitudinal direction;

a pair of nozzle guiders coupled to the case;

a plurality of gap-adjusting plates fixedly coupled to each of the nozzle guiders to adjust a gap between the nozzle guiders, wherein the nozzle guiders define a nozzle portion;

a plurality of passages defined by the gap-adjusting plates and the nozzle guiders, the plurality of passages communicating with the cavity of the case and allowing the fluid to be directed to the nozzle portion formed by the nozzle guiders; and a pressure-adjusting cavity disposed between the nozzle guiders near the nozzle portion to spray the fluid through the nozzle portion at a uniform pressure.

9. The fluid injector of claim 8, further comprising a tube disposed in the cavity of the case to receive fluid from a fluid-supplying apparatus, the tube being provided with a plurality of exhaust holes arranged at predetermined intervals.

10. The fluid injector of claim 9, wherein the fluid exhaust holes are formed such that they can exhaust fluid in a direction opposite to a direction where the fluid is injected.

11. The fluid injector of claim 8, wherein the pair of nozzle guiders are disposed facing each other and spaced apart to define a gap such that the nozzle portion comprises the gap.

12. The fluid injector of claim 8, wherein the pair of nozzle guiders comprise elongated linear plates having opposing longitudinal surfaces defining the plurality of passages and the nozzle portion.

13. A fluid injector for treating a surface of a flat display panel, comprising:

a case provided with a cavity for receiving fluid, the case and cavity being formed along a longitudinal direction;

a pair of nozzle guiders coupled to the case and defining a nozzle portion;

a plurality of gap-adjusting plates fixedly coupled to each of the nozzle guiders to adjust a gap between the nozzle guiders;

a plurality of passages defined by the gap adjusting plates and the nozzle guiders, the plurality of passages communicating with the cavity of the case and allowing the fluid to be directed to the nozzle portion;

a pressure control cavity disposed between the nozzle guiders near the nozzle portion to spray the fluid through the nozzle portion at a uniform pressure; and a tube disposed in the cavity of the case to receive fluid from a fluid-supplying apparatus, the tube being provided with a plurality of exhaust holes arranged at predetermined intervals.

14. The fluid injector of claim 13, wherein the pair of nozzle guiders define the pressure-adjusting cavity where pressure of the fluid is adjusted before being injected through the nozzle portion.

15. The fluid injector of claim 13, comprising a couple device coupling the pair of nozzle guiders, and the plurality of gap-adjusting plates between the pair of nozzle guiders.

16. The fluid injector of claim 13, wherein the pair of nozzle guiders are disposed facing each other and spaced apart to define a gap such that the nozzle portion comprises the gap.

17. The fluid injector of claim 13, wherein the pair of nozzle guiders comprise elongated linear plates having opposing longitudinal surfaces defining the plurality of passages and the nozzle portion.

* * * * *